US006612673B1

(12) United States Patent
Giere et al.

(10) Patent No.: US 6,612,673 B1
(45) Date of Patent: Sep. 2, 2003

(54) SYSTEM AND METHOD FOR PREDICTING DYNAMIC THERMAL CONDITIONS OF AN INKJET PRINTING SYSTEM

(75) Inventors: Matthew Giere, San Diego, CA (US); Satya Prakash, Poway, CA (US); Ronald A. Askeland, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/134,813

(22) Filed: Apr. 29, 2002

(51) Int. Cl.[7] ..... B41J 29/38
(52) U.S. Cl. ..... 347/14; 347/17
(58) Field of Search ..... 347/14, 17

(56) References Cited

U.S. PATENT DOCUMENTS 4,947,194 A * 8/1990 Kyoshima ..... 347/67
6,109,718 A * 8/2000 Murakami et al. ..... 347/14
6,406,113 B1 * 6/2002 Kato ..... 347/14
6,471,315 B1 * 10/2002 Kurata ..... 347/8
2001/0001558 A1 * 5/2001 Ishinaga et al. ..... 347/3

* cited by examiner

*Primary Examiner*—Hai Pham
*Assistant Examiner*—Alfred Dudding

(57) ABSTRACT

The present invention includes as one embodiment an inkjet printing system, having a substrate, a plurality of heating elements disposed on the substrate, an ink ejection assembly adjacent the substrate forming a plurality of ink ejection chambers, each chamber associated with a different one of the heating elements and a controller operatively connected to the heating elements, the controller receiving print data and processing the print data to predict thermal conditions of a subset of the ink ejection chambers for selectively operating the corresponding heating elements of the subset.

25 Claims, 6 Drawing Sheets

SYSTEM AND METHOD FOR PREDICTING DYNAMIC THERMAL CONDITIONS OF AN INKJET PRINTING SYSTEM

BACKGROUND OF THE INVENTION

One factor in assuring high print quality of inkjet printers is the control over the uniformity of ejected ink drops. Ink drop uniformity can be controlled by managing the temperature developed in heating elements, such as resistors, of the printhead. The heating elements reach high temperatures in order to produce explosive vaporization when vaporizing the ink. Some properties of an ink drop vary with temperature and there is an optimal temperature operating range for typical printheads using inks.

A heat-related problem can occur when the controller fires a heating element a number of times in a short period of time. This causes the heating element to reach a temperature that is higher than that required to produce ink drops having the correct size. Also, if the length of the current pulse to the resistor is longer than a pre-determined limit, the temperature of the heating element will again be too high for producing an ideal ink drop.

Another problem that can occur if the temperature at the heating element gets too high is that the gas formed will create bubbles that will choke the nozzle. In contrast, if the temperature is too low, the formation of ink droplets will be poor leading to a decrease in image quality of the image formed as these droplets are deposited on the print medium. These variations in drop weight, or the creation of bubbles, result in visible hue shifts and image quality defects.

Another potential problem caused by excessively high temperatures is that ink dyes can decompose leaving residues on the resistor surface. These residues can interfere with nucleation and drop formation, which can result in ink droplets with lower drop weight and lower velocity. This often causes print quality problems.

SUMMARY OF THE INVENTION

The present invention includes as one embodiment an inkjet printing system, comprising a substrate, a plurality of heating elements disposed on the substrate, an ink ejection assembly adjacent the substrate forming a plurality of ink ejection chambers, each chamber associated with a different one of the heating elements and a controller operatively connected to the heating elements, the controller receiving print data and processing the print data to predict thermal conditions of a subset of the ink ejection chambers for selectively operating the corresponding heating elements of the subset.

BRIEF DESCRIPTION OF THE DRAWINGS

The present invention can be further understood by reference to the following description and attached drawings that illustrate the preferred embodiments. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

In the following description of the invention, reference is made to the accompanying drawings, which form a part hereof, and in which is shown by way of illustration a specific example in which the invention may be practiced. It is to be understood that other embodiments may be utilized and structural changes may be made without departing from the scope of the present invention as defined by the claims appended below.

I. General Overview

Figure 1:
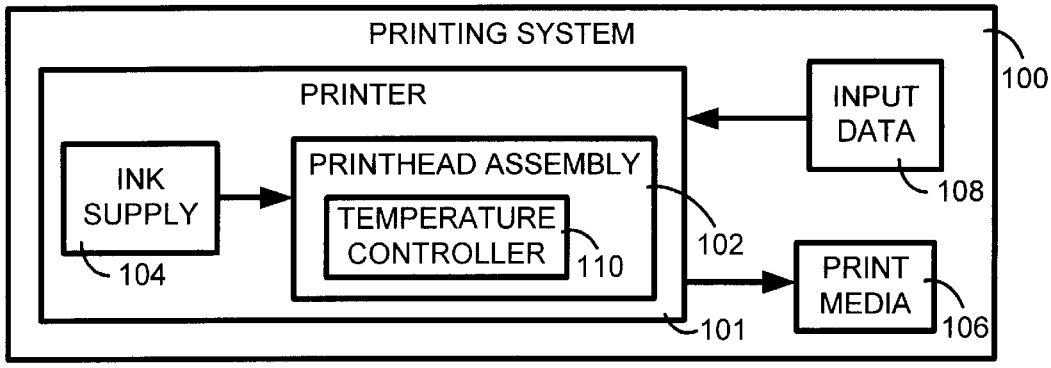
FIG. 1 shows a block diagram of an overall printing system incorporating one embodiment of the present invention.

FIG. 1 shows a block diagram of an overall printing system incorporating one embodiment of the present invention. The printing system 100 of one embodiment of the present invention includes a printhead assembly 102, ink supply or ink reservoir 104 and print media 106. The printhead assembly 102 and the ink reservoir 104 are typically included in a printer 101. Input data 108 is sent to the printing system 100 and includes, among other things, information about the print job. Also included is a temperature control system 110 for predicting dynamic thermal conditions of the printhead assembly 102. In addition, the printhead assembly 102 includes a substrate, such as a semiconductor wafer or die, with ink ejection elements and associated ejection chambers for releasing the ink through corresponding nozzles or orifices in an adjacent nozzle member.

In general, the temperature controller 110 is coupled to multiple temperature sensors (not shown). The multiple temperature sensors preferably determine, at a given time, a mean or average temperature of the substrate and an actual local temperature profile near designated ink ejection elements. The temperature controller 110 can be an integrated circuit, firmware, a software printer driver or the like which controls the mean temperature of the substrate of the printhead through a feedback loop (discussed in detail below).

When the sensors detect that the mean temperature of the substrate has dropped below a predefined baseline or threshold temperature, the loop activates the heating elements in an effort to raise the substrate above the baseline temperature before printing. As will be discussed subsequently in greater detail, the temperature controller 110 uses the input data 108 to predict thermal conditions of particular ejection chambers for selectively firing the associated heating elements.

Hence, the temperature controller 110 aids in controlling the temperature of the substrate and the temperature of each ejection chamber or nozzle chamber. This results in improved print quality and printhead life because the printhead 102 will consequently operate closer to its optimum temperature.

II. Exemplary Printing System

Figure 2:
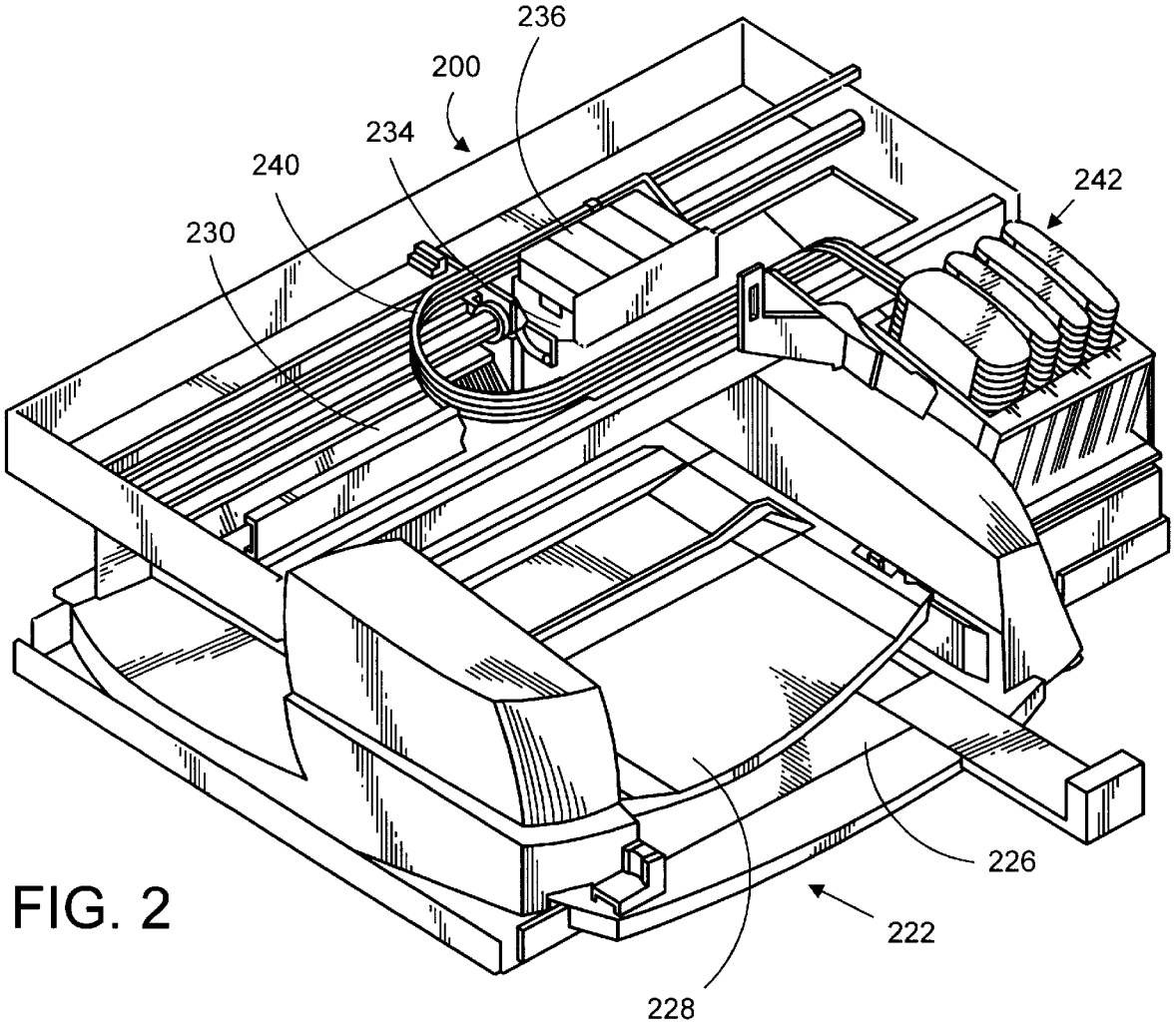
FIG. 2 is an exemplary printer usable with the system of FIG. 1 that incorporates one embodiment of the invention and is shown for illustrative purposes only.

FIG. 2 is an exemplary embodiment of a printer that incorporates an embodiment of the invention and is shown for illustrative purposes only. Generally, printer 200, which is shown in FIG. 2 as one type of printer 101 of FIG. 1, can incorporate the printhead 102 of FIG.1 and further include a tray 222 for holding print media. When printing operation is initiated, print media, such as paper, is fed into printer 200 from tray 222 preferably using sheet feeder 226. The sheet is then brought around in a U direction and then travels in an opposite direction toward output tray 228. Other paper paths, such as straight paper path, can also be used.

The sheet is stopped in a print zone 230, and a scanning carriage 234, supporting one or more printhead assemblies 236, is scanned across the sheet for printing a swath of ink thereon. After a single scan or multiple scans, the sheet is then incrementally shifted using, for example a stepper motor or feed rollers to a next position within the print zone 230. Carriage 234 again scans across the sheet for printing a next swath of ink. The process repeats until the entire sheet has been printed, at which point it is ejected into the output tray 228.

The print assemblies 236 can be removeably mounted or permanently mounted to the scanning carriage 234. Also, the printhead assemblies 236 can have self-contained ink reservoirs which provide the ink supply 104 of FIG. 1. Alternatively, each print cartridge 236 can be fluidically coupled, via a flexible conduit 240, to one of a plurality of fixed or removable ink containers 242 acting as the ink supply 104 of FIG. 1.

Figure 3:
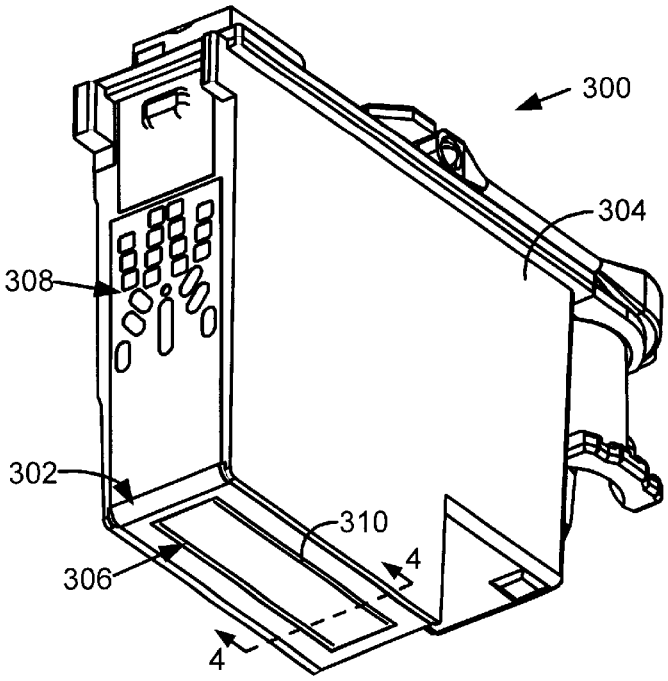
FIG. 3 shows for illustrative purposes only a perspective view of an exemplary print cartridge usable with the printer of FIG. 2 incorporating one embodiment of the present invention.

FIG. 3 shows for illustrative purposes only a perspective view of an exemplary print cartridge 300 (an example of the printhead assembly 102 of FIG. 1) incorporating one embodiment of the present invention. A detailed description of the present invention follows with reference to a typical print cartridge used with a typical printer, such as printer 200 of FIG. 2. However, the embodiments of the present invention can be incorporated in any printhead and printer configuration.

Referring to FIGS. 1 and 2 along with FIG. 3, the print cartridge 300 is comprised of a thermal head assembly 302 and a body 304. The thermal head assembly 302 can be a flexible material commonly referred to as a Tape Automated Bonding (TAB) assembly. The thermal head assembly 302 contains a nozzle member 306 to which the substrate is attached to form the printhead assembly 102. Thermal head assembly 302 also has interconnect contact pads (not shown) and is secured to the printhead assembly 300 with suitable adhesives. Contact pads 308 align with and electrically contact electrodes (not shown) on carriage 234. The nozzle member 306 preferably contains plural parallel rows of offset nozzles 310 through the thermal head assembly 306 created by, for example, laser ablation. Other nozzle arrangements can be used, such as non-offset parallel rows of nozzles.

III. Component Details

Figure 4:
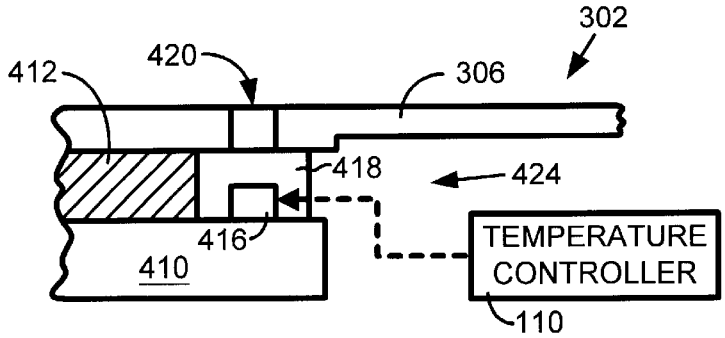
FIG. 4 is a schematic cross-sectional view taken through a portion of section line 4—4 of FIG. 3 showing a portion of the ink chamber arrangement of an exemplary printhead assembly in the print cartridge of FIGS. 1 and 3.

FIG. 4 is a cross-sectional schematic taken through a portion of section line 4—4 of FIG. 3 of the print cartridge 300 utilizing one embodiment of the present invention. A detailed description of one embodiment of the present invention follows with reference to a typical print cartridge 300. However, embodiments of the present invention can be incorporated in any printhead configuration. Also, the elements of FIG. 4 are not to scale and are exaggerated for simplification.

Referring to FIGS. 1–3 along with FIG. 4, in general, the thermal head assembly 302 includes a substrate 410 and a barrier layer 412 located between the nozzle member 306 and the substrate 410 for insulating conductive elements from the substrate 410 and for forming a plurality of ink ejection chambers 418 (one of which is shown). Also included are a corresponding plurality of heating elements 416 disposed on the substrate. The temperature controller 110 is operatively connected to the heating elements 416. Each chamber 418 is associated with a different one of the heating elements 416. The temperature controller 110 receives print data and processes the print data to predict thermal conditions of a subset of the ink ejection chambers 418 for selectively operating the corresponding heating elements 416 of the subset.

An ink ejection or vaporization chamber 418 is adjacent each ink ejection element 416, as shown in FIG. 4, so that each ink ejection element 416 is located generally behind a single orifice or nozzle 420 of the nozzle member 306. The nozzles 420 are shown in FIG. 4 to be located near an edge of the substrate 410 for illustrative purposes only. The nozzles 420 can be located in other areas of the nozzle member 306, such as centered between an edge of the substrate 410 and an interior side of the body 304.

The ink ejection elements 416 may be resistor heater elements or piezoelectric elements, but for the purposes of the following description, the ink ejection elements are referred to as resistor heater elements. In the case of resistor heater elements, each ink ejection element 416 acts as an ohmic heater when selectively energized by one or more pulses applied sequentially or simultaneously to one or more of the contact pads via the integrated circuit.

The orifices 420 may be of any size, number, and pattern, and the various figures are designed to simply and clearly show the features of one embodiment of the invention. The relative dimensions of the various features have been greatly adjusted for the sake of clarity.

Figure 5:
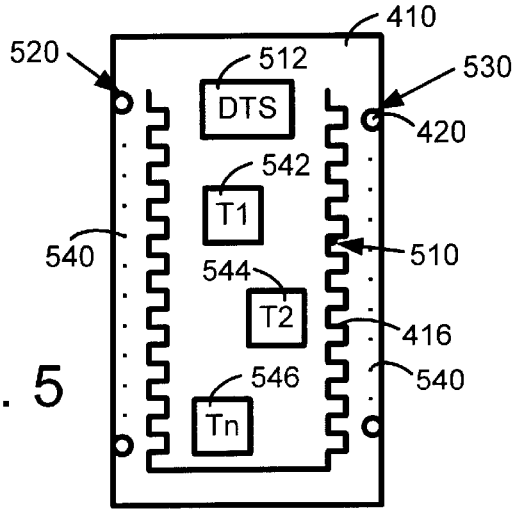
FIG. 5 is a schematic top view of the substrate of the printhead assembly of FIG. 4 according to one embodiment of the present invention.

FIG. 5 is a top view of the substrate in one embodiment of the present invention. Referring to FIGS. 1–4 along with FIG. 5, the temperature controller 110 of FIG. 1 is coupled to at least one measurement sensor. In one embodiment, there are two measurement sensors, namely, a thermal sense resistor (TSR) 510 and a digital temperature sensor (DTS) 512. One or multiple TSRs 510 can be used to provide an approximation of the mean temperature of the substrate. Preferably, it is not located adjacent to any particular heating element and reflects the temperature of the substrate 410 after heat has moved from the heating elements to the TSR 510. The TSR 510 therefore reports a temperature that reflects heating element firings that have already occurred.

Conversely, the DTS 512 is a point sensor located at the top of the substrate 410 between a first column 520 of nozzles 420 (not shown to scale) and a second column 530 of nozzles 420 (the dotted lines 540 represent numerous consecutive nozzles, which are not shown for simplicity). While this sensor 512 typically more accurately reflects the temperature at that point, it does not give an accurate temperature for other heating elements on the substrate 410. Therefore, in one embodiment of the present invention, the temperature controller 110 uses both the TSR 510 and the DTS 512 to control the temperature.

In one embodiment, the DTS 512 is located in the center of the substrate 410, between the first and second rows 520, 530 of the lower numbered nozzles at the top portion of the substrate. The TSR 510 is located along the length of the substrate 410. The TSR 510 can have two legs that are approximately 680 um inboard from the center of the columns of ink ejection elements 416.

In addition, the substrate includes temperature recorders 542, 544, 546 that work with the measurement sensors to allow the temperature controller 110 to improve the thermal efficiency of the printhead 102 by predicting dynamic thermal effects. The temperature recorders 542, 544, 546 are shown in FIG. 5 as three recorders for illustrative purposes and any suitable number of recorders can be used to determine the mean temperature of the substrate 410 as well as localized actual temperature profiles of the substrate 410. Referring to FIG. 5 along with FIGS. 1–4, the substrate includes plural temperature recorders T1 542, T2 544, Tn 546 that are coupled to the temperature controller 110. Each temperature recorder 542, 544, 546 records a temperature at a predefined specific location on the substrate 410.

The temperature recorders 542, 544, 546 are strategically distributed around the substrate 410 and each measures a local temperature. The local temperatures are then averaged to generate a mean average temperature of the substrate 410. Also, plural thermal sense resistor (TSR) temperature recorders can be located along paths of predefined areas near ink ejection elements for generating actual localized temperature profiles, as discussed above, along the length of the TSRs. Also, each temperature recorder 542, 544, 546 has a memory with a library of temperature histories based on a variety of thermally important variables. The temperature input, therefore reflects a history that can be used to predict future temperature conditions, in addition to the actual temperature of the substrate.

Referring to FIGS. 1–4, during a printing operation, ink stored in an ink reservoir 424 defined by the printhead body 304 generally flows around the edges of the substrate 410 and into the vaporization chambers 418. Energization signals are sent to the ink ejection elements 416 and are produced from the electrical connection between the print cartridges 236 and the printer 200. Upon energization of the ink ejection elements 416, a thin layer of adjacent ink is superheated.

In particular, the energized heater element 416 causes explosive vaporization and, consequently, causes a droplet of ink to be ejected through the orifice or nozzle 420. The vaporization chamber 418 is then refilled by capillary action. This process enables selective deposition of ink on print media 106 to thereby generate text and images. Consequently, when the printhead assembly 300 is scanned across the print media during printing, variations in the size or physical nature of the ink droplet will affect the location and/or the action of the ejected ink on the print media and therefore affect the quality of printing.

Temperature control plays an important role in the variation in the size or physical nature of the ink droplet. For instance, the ideal mean temperature of the substrate 410 for ejecting an ink droplet is about 50 degrees C, but the heating elements 416 can reach a temperature of 500 degrees C in 3 microseconds. If the temperature controller 110 instructed firing to occur several times in a short period, or if the width of the firing pulse was lengthened, the heating element 416 would reach a temperature above that required to produce the correct sized ink drop.

In operation in one embodiment of the present invention, thermal conditions of a subset of the ink ejection elements 416 are predicted before the sensor 510 and 512 of FIG. 5 senses a temperature of the subset. Then operating conditions for the subset are set so that the corresponding heating elements 416 operate at an optimal temperature. In another embodiment, a firing history of a plurality of subsets of ink ejection elements are maintained, an average temperature of the printhead assembly 102 is sensed, and the firing history and the average temperature is processed to determine estimated temperatures of certain ones of the subset. Then operating conditions for the certain ones of the subset are set so that the corresponding heating elements operate at an optimal temperature.

IV. Operation Details

Figure 6A:
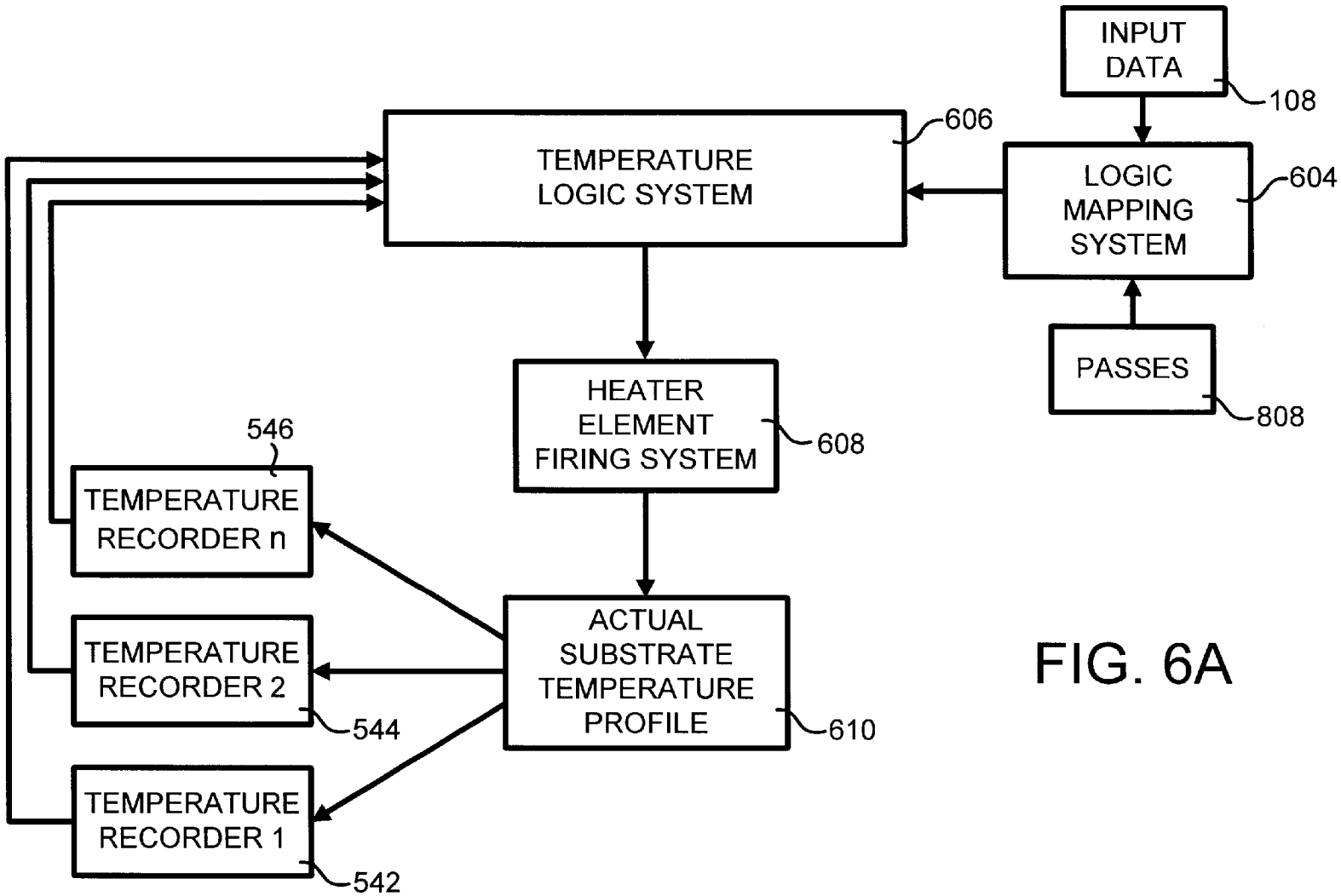
FIG. 6A is a basic flow diagram illustrating the data flow between various elements of a printhead that incorporates one embodiment of the present invention.

Referring to FIGS. 1–5 along with FIG. 6A, in general, the temperature controller 110 can have integrated circuitry that includes a logic mapping system 604 which defines the timing and sequencing in which certain ink ejection chambers 418 are fired in order to deposit ink drops on the medium in the pixel locations required to produce the image, and a temperature logic system 606 that generates various printing parameters. The logic mapping system 604 is a feature of the temperature controller 110 that analyzes the input data 108 and a number of passes that the printhead 300 makes and defines the image to be printed as a pattern of individual dots printed at particular locations of an array defined for the printing medium 106.

During operation, an actual temperature profile 610, which includes a current temperature of the substrate 410, is sent to the multiple temperature recorders 542, 544, 546 that each measure current temperatures and store the measurements as temperature histories of certain respective portions the printhead assembly 102. These temperature recorders 542, 544, 546 send recorded mean temperatures and a history of recorded temperatures of the substrate to the temperature logic system 606 along with past and future printing data from the logic mapping system 604 that is indicative of which ink ejection chambers 418 will be fired, and when each will be fired.

The temperature logic system uses these temperature and printing inputs, as well as some embedded knowledge (such as latencies in the response of the sensors to firing, and conduction paths between different nozzles since there may be slots separating some nozzles but not others), to generate printing parameters and then output them in a closed loop system to the actual substrate temperature profile 610. The printing parameters can include pulse widths, pulse rates, ink ejection chambers 418 to be fired and when they will be fired, warming using non-ejecting devices, and firing voltages that act as the inputs for the actual substrate temperature profile 610. Since a true temperature profile is difficult to measure, this closed loop method allows approximation of a temperature profile to improve ink drop quality.

Figure 6B:
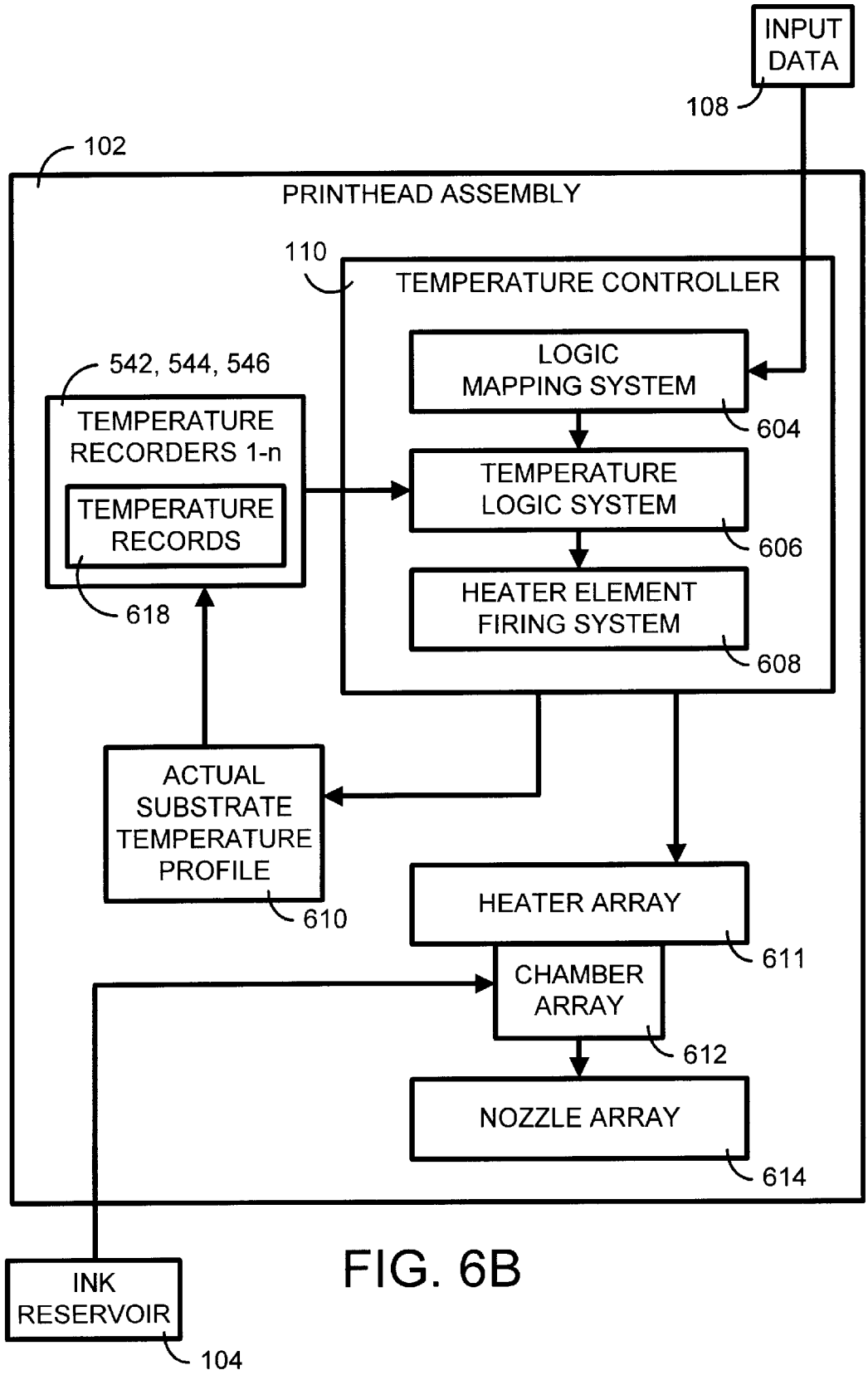
FIG. 6B is a more detailed flow diagram of a printhead according to FIG. 6A that incorporates an embodiment of the present invention.

FIG. 6B is a detailed diagram of the printhead assembly 102 illustrated in FIG. 1. In particular, referring to FIGS. 1–5 along with FIG. 6A, FIG. 6B shows that during a printing operation, ink is provided from an internal or external ink supply, such as the ink reservoir 104, to an interior portion of the printhead 102. The interior portion of the printhead 102 provides ink to the ink ejection chamber array 612 via ink channels (not shown) for ejecting ink from the individual chambers (not shown) through nozzles of the nozzle array 614 adjacent to each chamber. The printhead assembly 102 receives commands from the temperature controller 110 to eject ink onto the print media 106 so as to form a desired pattern of text and images. Print quality of the desired pattern is dependent, among other factors, on accurate placement of the ink droplets on the print media 106.

The temperature logic system 606 is typically included in the controller 110. The temperature logic system 606 receives the mapped data from the logic mapping system 604. The locations are mapped to a predefined imaginary dot grid, such as a rectilinear array for spatially defining the desired location of the dots to be printed on the media. The dots represent pixels that vary in density. Providing small dots in the rectilinear array means that more dots can be printed per inch of the printed media and require a greater number of heater elements 608 being fired.

An increase in the total number of heater elements 608 firing, or an increase in the rate of firing of heater elements 608 will result in an increase in the mean substrate temperature from the collective average of the recorded temperature of each temperature recorder 542, 544, 546. It should be noted that the greatest increase in temperature is in the recorders closest to the heater elements being fired. An increase in the firing of any heater element in the heater element firing system 608, whether it is due to an increase in the rate of firing, or due to an increase in the width of the electrical pulse to the heater element will result in an increase in temperature at that individual heater element. As the dot size depends on the ink being at an optimal temperature when the heater element 608 fires, it is important that these factors be monitored. Thus, one embodiment of the present invention provides a means to co-ordinate these factors in a controller, the temperature logic system 606.

The temperature logic system 606 utilizes general and specific data. The general data is global data that includes the total number of ejection element firings that are occurring at any given time and can also include the mean overall temperature. A portion of the general data is sent from the logic mapping system 604 and another portion is sent to the temperature logic system from the temperature recorders 542, 544, 546. For example, the temperature recorders 542, 544, 546 provide the temperature logic system 506 with the mean temperature of the substrate. The temperature recorders each have a memory with temperature histories. The temperature input, therefore is a history that can be used to extrapolate future temperature conditions, in addition to providing the actual temperature of the substrate.

The specific data includes measured actual temperature profiles, as well as the firing that is done by specific nozzle groups. The information about the nozzle firings is sent from the logic mapping system 604, and the temperature recorders 542, 544, 546 measure the actual temperature profiles. The specific data is sent to the temperature logic system 606 from the logic mapping system 604, as has been discussed heretofore.

If the system determines the substrate would be too cool, adjustments need to be made to prevent the formation of ink drops that would be too small; conversely, if the substrate would be too hot, modifications need to be made to prevent bubble formation in the chamber array 612 and a consequent build up of residues.

The flow of ink also has an effect on the temperature of the substrate. The ink flows from the ink reservoir 104 through the ink channels 620 to the chamber array 612. Ink is drawn into the chamber array 612 when the ink drops are ejected from the nozzle array 614.

Figure 6C:
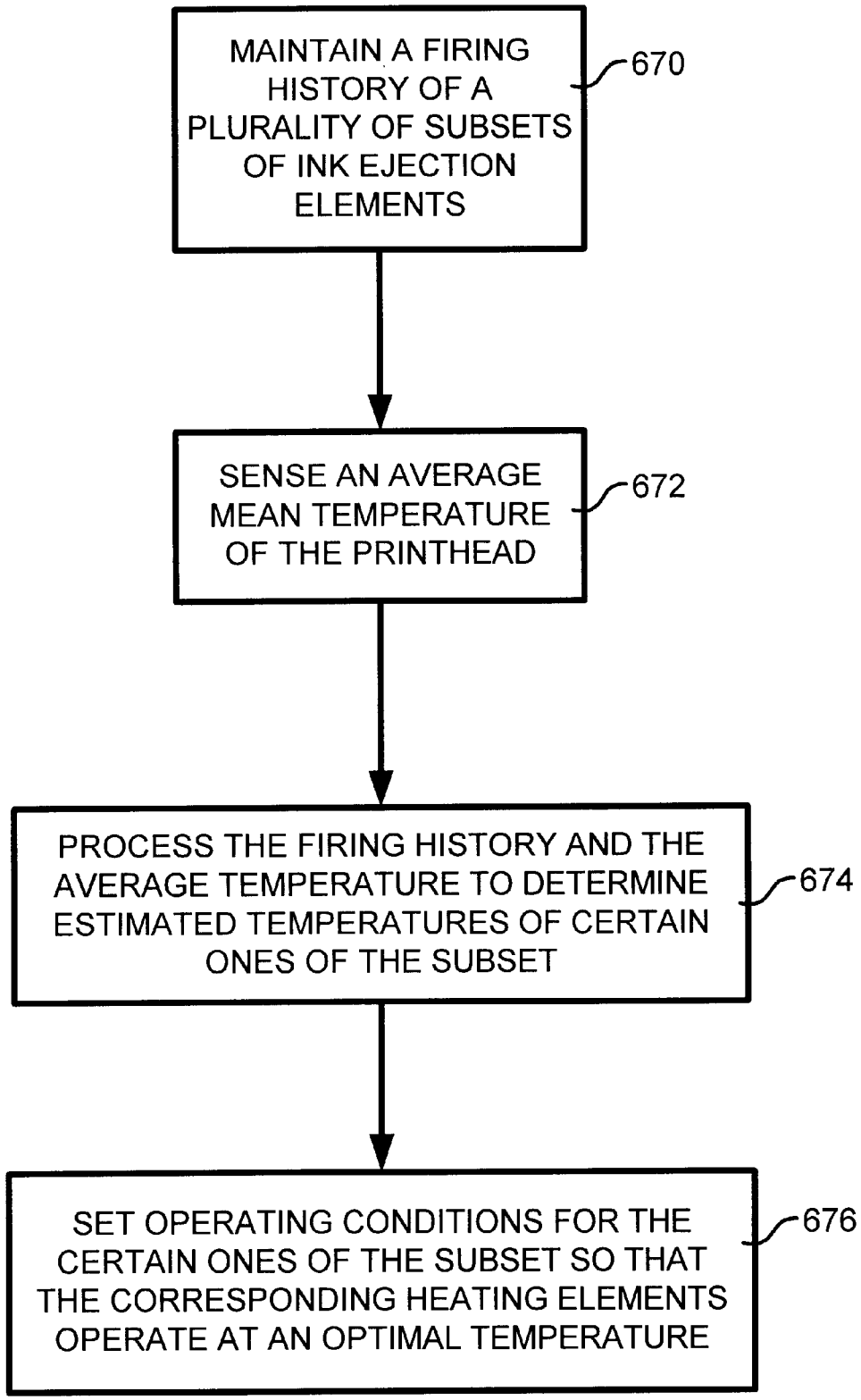
FIG. 6C is an operational flow chart of a printhead according to FIG. 6A that incorporates an embodiment of the present invention.

FIG. 6C is an operational flow chart of a printhead according to FIG. 6A that incorporates an embodiment of the present invention. In general, in operation, first a firing history of a plurality of subsets of ink ejection elements is maintained (step 670). Second, a mean temperature of the printhead is sensed (step 672). Third, the firing history and the average temperature are processed to determine estimated temperatures of certain ones of the subset (step 674). Last, operating conditions for the certain ones of the subset are set so that the corresponding heating elements operate at an optimal temperature (step 676).

Figure 7:
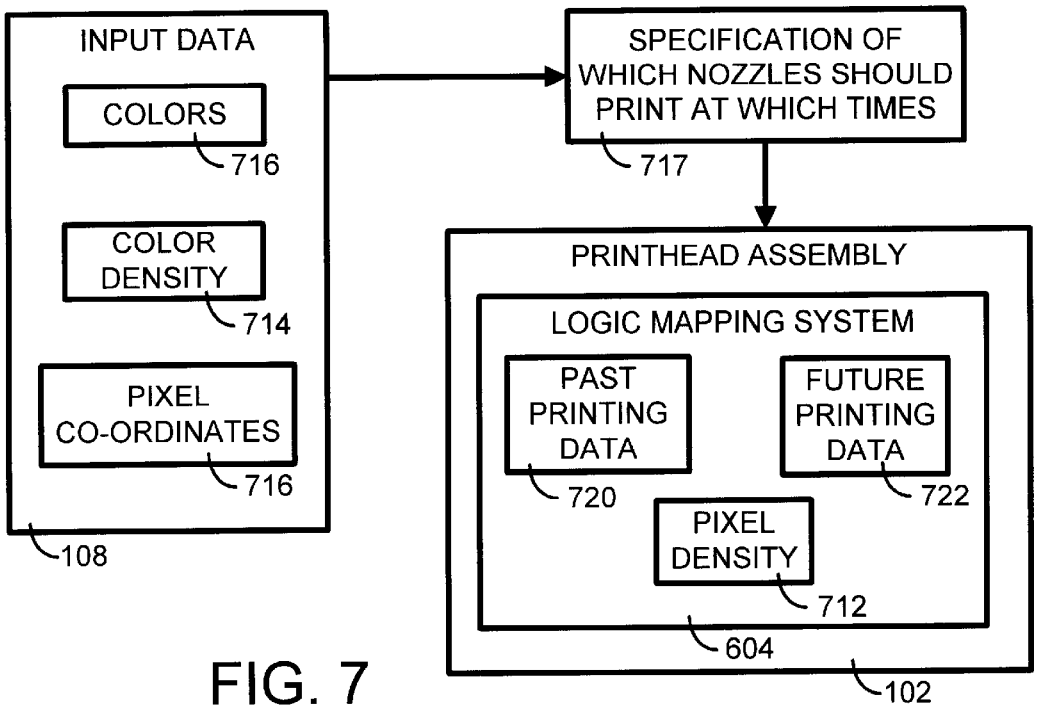
FIG. 7 shows a block diagram of the input data interaction with the logic mapping system of FIGS. 6A and 6B in one embodiment of the present invention.

FIG. 7 shows a block diagram of the input data interaction with the logic mapping system 604 of one embodiment of the present invention. Input data 108 either contains, or can be processed to determine, the pixel co-ordinates 716, the number and density of pixels 712 to be produced, the colors 716 of each pixel, and the color densities 714 of each pixel and specification of which nozzles should print at which times 717. The logic mapping system 604 contains past printing data 720, and also contains future printing data 722 (such as which ink ejection chambers 418 will be operated when, as determined in advance of the actual printing from the input data 108) that can be used in conjunction with the temperature data to set printing parameters.

The logic of the system operates in general by first having each temperature recorder record a series of temperatures. Next, the temperature logic system 606 uses the recorded temperatures along with the firing data discussed above from the logic mapping system 604 to recreate as closely as possible an estimated temperature profile 610. This can be accomplished by interpolating and extrapolating the firing data and the measured temperatures at the discrete measurement points to estimate a profile. Basically, the temperature logic system 606, via the closed loop with the logic mapping system 604, is used to estimate the substrate temperature profile. The estimated substrate temperature profile is passed to the heater element firing system 608 for appropriately firing the heater elements.

Figure 8:
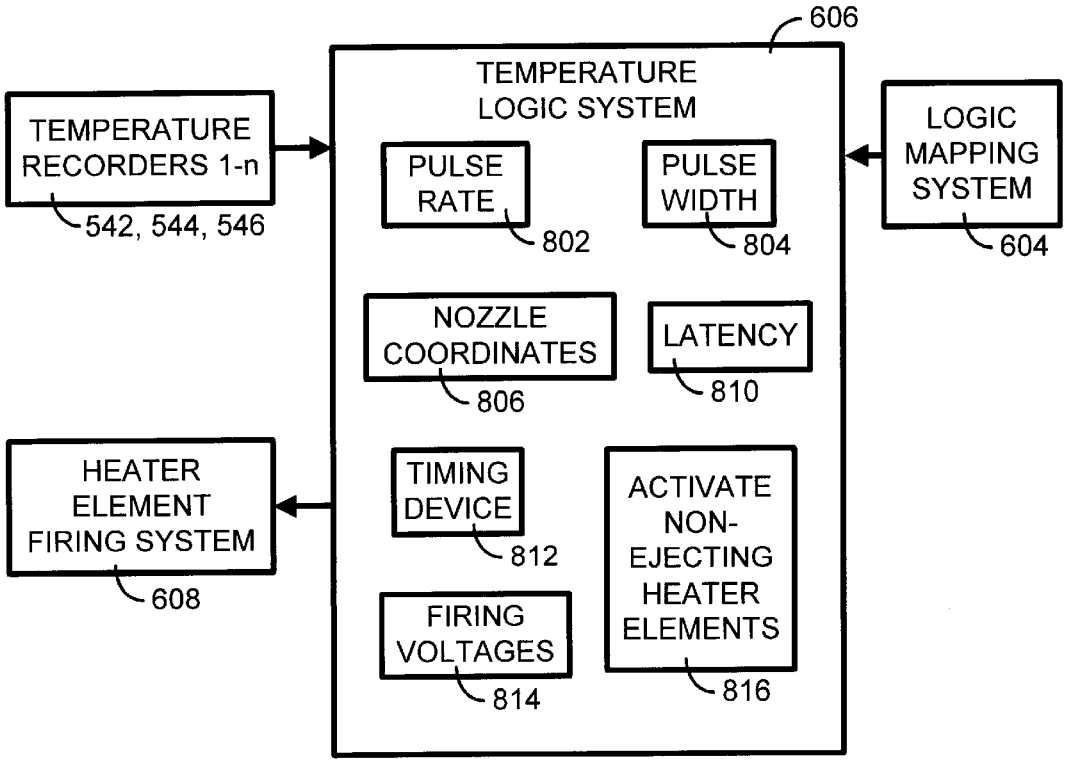
FIG. 8 shows a more detailed block diagram of one embodiment of the temperature logic system of FIGS. 6A and 6B according to the present invention.

FIG. 8 shows a block diagram of the temperature logic system incorporated in one embodiment of the present invention. The temperature logic system 606 analyzes the data from the temperature recorders 542, 544, 546 and the logic mapping system 604. The analysis includes receiving specific data from the logic mapping system 604 and general data from the temperature recorders 542,544,546, and automatically compiling the order and length of firing of heater elements 608 to operate the ink ejection chambers 418 in the printhead assembly 102.

This is a predictive function. The logic mapping system 604 defines the timing and sequencing in which certain ink ejection chambers 418 are fired. The logic mapping system 604 determines whether inkjet elements of the subset have been printing. Also, a first group of operating conditions is set if the elements of the subset have been printing, and a second group of operating conditions is set if the elements of the subset have been quiescent.

The logic mapping system 604 passes this past and future data to the temperature logic system 606, which generates the pulse rate 802, pulse width 804, nozzle coordinates 806 and firing voltages 814. The pulse width 804, voltage to resistors 814, heating using elements other than the resistors, the identity of nozzles to be fired and the specific times they are to be fired, are based on previous input data from temperature records 618, as well as the current input data 108.

This information is combined with the feedback on the recorded temperature of the substrate 410 and the effect of the latency of heating of the substrate elements to determine the pattern of nozzle firing. From the colors 716, the color density 714 and the pixel co-ordinates 716, the temperature logic system 606 determines the specific nozzles from the nozzle co-ordinates 806 that need to be engaged to produce the image on the print media.

The temperature logic system 606 then determines the firing rate and pulse width for each color controlled for pulse rate 802 and for pulse width 804, and forwards the firing order to the heater element firing system 608, through the timing device 812. This rate, width and order of firing are programmed, and if necessary, adjusted in the programming, so that the temperature of the heater array 611, and therefore the temperature of the ink in the chamber array 612, are maintained at an optimum temperature for the formation of ink droplets. The temperature logic system also generates firing voltages 814 and activates heater elements that do not eject ink 816.

In addition the timing device 812 makes adjustments to the number or width of firing pulses from the heater element firing system 608 in accordance with information from the temperature recorders 542, 544, 546 and the effect the firing of the heater element firing system 608 will have on the mean temperature. The heat from the heater elements will have to pass through the body of the substrate before reaching the temperature recorders 542, 544, 546. There will therefore be a difference in temperature between the recorder and the heater elements. The controller element that calculates latency 810 will allow for this difference.

The temperature logic system 606 therefore acts as a predictive system for maintaining the substrate at an optimum temperature for producing ink droplets. As a result, the quality of the ink droplets will be increased. Further, since the firing system limits the rate, voltage or pulse width of firing of heater elements, less energy will be used. As such, the printhead assembly 102 will be easier to maintain with less residue being deposited on the heater array 611 or in the chamber array 612 or the nozzle array 614.

The foregoing has described the principles, preferred embodiments and modes of operation of the present invention. However, the invention should not be construed as being limited to the particular embodiments discussed. The above-described embodiments should be regarded as illustrative rather than restrictive, and it should be appreciated that workers may make variations in those embodiments skilled in the art without departing from the scope of the present invention as defined by the following claims.

What is claimed is:

1. An inkjet printing system, comprising:

a substrate;

a plurality of heating elements disposed on the substrate;

a plurality of ink ejection chambers adjacent the substrate, each chamber associated with a different one of the heating elements; and a controller operatively connected to the heating elements, the controller receiving and processing print data to predict thermal conditions of a subset of the ink ejection chambers, and operating selected ones of the corresponding heating elements of the subset according to the thermal conditions;

wherein the controller includes multiple temperature sensors to determine temperature profiles of at least some associated ones of the heating elements and further includes a logic mapping system that determines future printing data related to the predicted thermal conditions.

2. The inkjet printing system of claim 1, wherein the controller is disposed on the substrate.

3. The inkjet printing system of claim 1, wherein the controller is preprogrammed to operate the heating elements at an optimal temperature.

4. The inkjet printing system of claim 1, wherein the print data includes at least one of firing pulse frequency, firing pulse width, and an amount of firing done by specific ejection chambers to allow the controller to estimate and control ink drop ejection temperature.

5. The inkjet printing system of claim 1, wherein the future printing data defined by the logic mapping system includes pixel coordinates.

6. The inkjet printing system of claim 1, wherein the future printing data defined by the logic mapping system includes at least one of a number and density of pixels to be produced and colors of each pixel.

7. The inkjet printing system of claim 1, wherein the controller further comprises a temperature logic system that determines appropriate firing conditions for the selected heating elements based on the future printing data and the temperature profiles.

8. The inkjet printing system of claim 7, wherein based on the pixel data, the logic mapping system identifies which of the ink ejection chambers will be fired, and a corresponding set of times at which the identified ink ejection chambers will be fired, in order to produce an image on a print media.

9. The inkjet printing system of claim 8, wherein each of the firing conditions includes a firing rate, a firing energy, and a firing pulse width.

10. The inkjet printing system of claim 9, wherein the firing rate, firing pulse width, and firing energy are programmed so that the temperature of the heater elements are maintained at an optimum temperature for the formation of ink droplets.

11. A method for printing with a thermal inkjet printhead having a plurality of ink ejection elements, each ink ejection element having a heating element, comprising:

predicting thermal conditions of a subset of the ink ejection elements before a temperature of the subset is sensed;

setting operating conditions for the subset so that the corresponding heating elements operate at an optimal temperature.

determining whether inkjet elements of the subset have been printing; and setting a first group of operating conditions if the elements of the subset have been printing, and setting a second group of operating conditions if the elements of the subset have been quiescent.

12. The method of claim 11, wherein the subset is selected from the group consisting of a single element, a set of adjacent elements, and all elements.

13. The method of claim 11, wherein the predicting includes determining a firing rate of the subset, and wherein the setting includes setting a firing pulse width for the subset.

14. The method of claim 13, wherein the predicting further includes determining an average temperature of the subset of the ink ejection elements.

15. A method for printing with a thermal inkjet printhead having a plurality of ink ejection elements, each ink ejection element having a heating element, comprising:

maintaining a firing history of a plurality of subsets of ink ejection elements;

sensing mean temperature of the printhead;

processing the firing history and the average temperature to determine estimated temperatures of certain ones of the subset; setting operating conditions for the certain ones of the subset so that the corresponding heating elements operate at an optimal temperature; and determining future printing data related to predicted thermal conditions, wherein the future data includes pixel coordinates and at least one of a number and density of pixels to be produced and colors of each pixel.

16. The method of claim 15, wherein based on the future data, further comprising determining a number of passes and a specific number of ejection chambers that need to be engaged to produce the image on the print media.

17. The method of claim 15 further comprising determining a firing rate, firing energy and a pulse width for each color controlled for color pulse rate and for color pulse width and then distributing the firing rate and firing energy to the heater elements for selectively firing specified heater elements.

18. The method of claim 17, wherein the firing rate, pulse width and firing energy are programmed so that the temperature of the heater elements are maintained at an optimum temperature for the formation of ink droplets.

19. An inkjet printhead having a plurality of ink ejection elements, each ink ejection element having a heating element, the inkjet printhead comprising:

means for predicting thermal conditions of a subset of the ink ejection elements before a temperature of the subset is sensed; and means for setting operating conditions for the subset so that the corresponding heating elements operate at an optimal temperature;

means for determining whether inkjet elements of the subset have been printing; and means for setting a first group of operating conditions if the elements of the subset have been printing, and setting a second group of operating conditions if the elements of the subset have been quiescent.

20. The inkjet printhead of claim 19, wherein the means for predicting includes means for determining a firing rate of the subset, and wherein the setting includes means for setting a firing pulse width for the subset.

21. The inkjet printhead of claim 19, wherein the means for predicting further includes means for determining an average temperature of the thermal inkjet printer.

22. A temperature control system for a thermal inkjet printer having ink ejection chambers that deposit ink on a print medium as an image, the control system comprising:

a logic mapping system that defines timing and sequencing data in which predefined ink ejection chambers are fired;

a temperature logic system that receives and analyzes the timing and sequencing data to predict thermal conditions of a subset of the ink ejection chambers; and a heater element firing system including plural heater elements, wherein the heater element firing system receives instruction signals from the temperature logic system to selectively operate heater elements corresponding to the subset of ink ejection chambers;

wherein the timing and sequencing data of the logic mapping system is used to define specific pixel locations of ink drops deposited on the print medium for producing the image.

23. The system of claim 22, wherein the temperature logic system defines the image to be printed as a pattern of individual dots printed at particular locations of an array defined for the printing medium.

24. The system of claim 22, further comprising a plurality of temperature recorders that measure current temperatures near the ink ejection chambers and store the measurements as temperature histories.

25. The system of claim 22, wherein the heater element firing system further comprises a heater array of heater elements located near a chamber array of ink ejection elements located adjacent to a nozzle array of nozzles that releases the ink from the ink ejection chambers onto the print medium.

* * * * *